US005117922A

United States Patent [19]

Baron

[11] Patent Number: 5,117,922

[45] Date of Patent: Jun. 2, 1992

[54] ISOLATOR ASSEMBLY FOR A PNEUMATIC UNDERGROUND PIERCING TOOL

[75] Inventor: Michael Baron, Orange, Ohio

[73] Assignee: Allied Steel & Tractor Products, Inc., Solon, Ohio

[21] Appl. No.: 541,053

[22] Filed: Jun. 20, 1990

[51] Int. Cl.[5] ..... B25D 9/04
[52] U.S. Cl. ..... 173/091; 173/210
[58] Field of Search ..... 173/91, 134, 139

[56] References Cited

U.S. PATENT DOCUMENTS

| | | | |
|---|---|---|---|
| 1,088,520 | 2/1914 | Black . | |
| 2,138,176 | 11/1938 | Keys | 243/358 |
| 2,762,341 | 9/1956 | Salengro | 173/139 |
| 3,137,483 | 6/1964 | Zinkiewicz | 262/1 |
| 3,407,884 | 10/1968 | Zzgmunt | 173/91 |
| 3,410,354 | 11/1968 | Sudnishnikov | 173/125 |
| 3,496,840 | 2/1970 | Wandel | 92/85 |
| 3,651,874 | 3/1972 | Sudnishnikov | 173/91 |
| 3,705,633 | 12/1972 | Sudnishnikov | 173/91 |
| 3,708,023 | 1/1973 | Nazarov | 175/19 |
| 3,727,701 | 4/1973 | Sudnishnikov | 173/91 |
| 3,756,328 | 9/1973 | Sudnishnikov | 173/91 |
| 3,763,939 | 10/1973 | Sudnishnikov | 173/91 |
| 3,881,554 | 5/1975 | Cooley et al. | 173/139 |
| 3,920,086 | 11/1975 | Goppen | 173/134 |
| 3,995,702 | 12/1976 | Klimashko | 173/91 |
| 4,078,619 | 3/1978 | Sudnishnikov | 175/19 |
| 4,132,277 | 1/1979 | Tupitsyn | 175/19 |
| 4,872,516 | 10/1989 | MacFarlane et al. | 173/139 |

FOREIGN PATENT DOCUMENTS 800725 9/1958 Fed. Rep. of Germany .

OTHER PUBLICATIONS

IP-4601 Technical and Shipping Documents, Dec. 9, 1969, Building-and-Finishing Equipment Works, USSR.

IP-4601 Pneumatic Puncher—Certificate and Operating Instructions, Dec. 9, 1969, Odessa Printing and offset Plant, Order No. 12724 (with translation).

USSR Inventor's Certificate No. 392,215, corresponding to App. No. 1,050,524, filed Jan. 22, 1966 (with translation), Sudnishnikov.

USSR Inventor's Certificate No. 126,446 (1960) (with translation).

*Primary Examiner*—Douglas D. Watts
*Assistant Examiner*—Scott A. Smith
*Attorney, Agent, or Firm*—Lyon & Lyon

[57] ABSTRACT

An isolator assembly is disclosed for supporting internal component inside a pneumatic underground piercing tool having an axial body propelled by impact forces of a striker responsive to the application of compressed air. The isolator assembly is comprised of an isolator housing mounted to the body of the piercing tool in a manner that allows relative axial movement between the body and the isolator housing. The internal components to be protected from the impact forces are mounted on the isolator housing. An elastomeric member is positioned to permit the isolator housing and internal components mounted thereon to move resiliently in the axial direction relative to the body of the piercing tool during each impact of the striker.

5 Claims, 2 Drawing Sheets

ISOLATOR ASSEMBLY FOR A PNEUMATIC UNDERGROUND PIERCING TOOL

This invention relates to a pneumatically operated underground piercing device and, in particular, to an isolator assembly that supports various internal components of the piercing device including the components of a guidance and steering system inside the piercing device and protects these components from the negative effects of impact and shock loads.

Pneumatically operated devices have been developed for creating a hole in the ground by the internal mechanism of the bullet-shaped device causing forwardly directed impacts to advance the device through the soil and compressing the soil to form the hole. The device is connected by a hose to a source of compressed air and aimed in the desired direction whereupon it is self-propelled through the earth to the desired destination. These devices are particularly useful in forming a generally horizontal hole under a street or other surface obstruction to install pipes, cables or the like without the necessity of digging a trench across the obstructed surface or the problems in boring a hole. A small trench is dug on either side of the surface obstruction and the pneumatically operated device is aimed from one trench to the other beneath the surface obstruction.

Several different mechanisms and methods have also been developed to reverse the direction of travel of the pneumatically operated device in order to retract the device on occasions when, for example, the device runs into an obstruction or diverts off course. There have been attempts to provide pneumatically operated underground tools with guidance and steering systems that allow the operator to control or manipulate the direction of travel of the tool as it travels in a forward direction. A problem experienced with the guidance and steering system in the pneumatically operated device is the breaking or failure of various mechanical and electrical components during the normal operation of the tool. The components of the guidance and steering systems such as the various components of a sensor assembly incorporated into the pneumatic operating tool have proven to be very sensitive and easily damaged by the repetitive impact and shock loads resulting from the operation of the striker. Breakage of various mechanical and electrical components including the connecting sub, roll sensor housing, magnetic source coil, roll sensor, twin line hose, and sensor connector made the tool unreliable and difficult to maintain.

Accordingly, it is an object of this invention to provide an improved underground piercing tool with a guidance and steering system that allows the tool to operate in the field with greater reliability.

A more detailed object of this invention is to provide an isolator assembly that supports various internal components of an underground piercing tool including the components of a guidance and steering system inside the piercing tool while reducing the negative effects of the impact forces of the striker.

Another more detailed object of this invention is to provide an isolator assembly that absorbs and dissipates shock loads by permitting movement of external body components and internal housing components relative to each other. Other and more detailed objects and advantages of the present invention will be apparent to those skilled in the art from the following description and the accompanying drawings whereas:

Figures 1, 2, 2A, 2B:
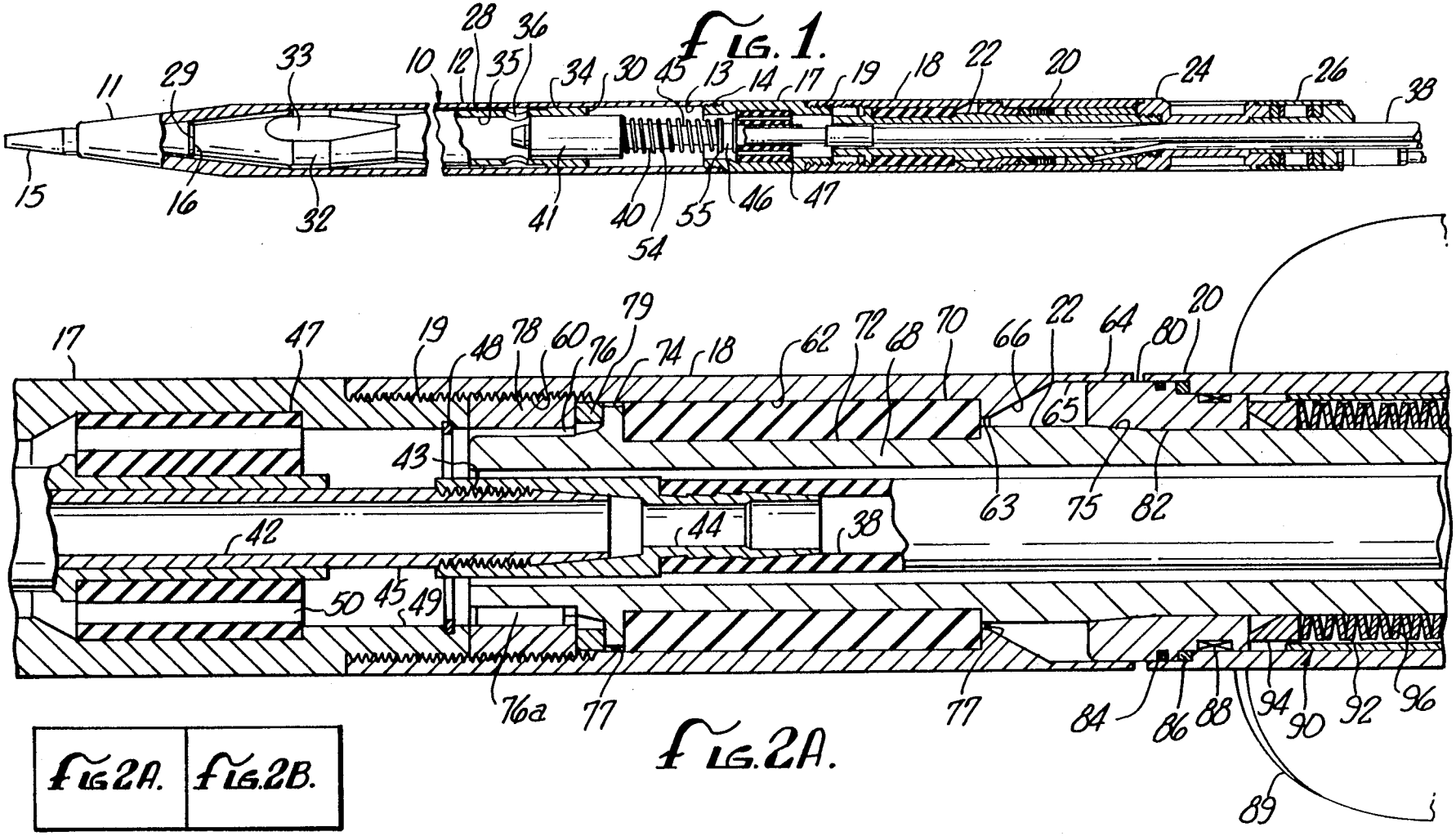
FIG. 1 is a sectional side view of the underground piercing tool illustrating a first embodiment of the isolator assembly with the tool illustrated in the forward mode of operation and the striker impacting on the front of the tool for imparting forward motion.
FIG. 2 is a diagram illustrating the relationship between FIGS. 2A and 2B.
FIGS. 2A and 2B are enlarged fragmentary sectional side views of FIG. 1 illustrating the components of the isolator assembly of this invention with FIG. 2B also illustrating the components of a sensor assembly.
Figure 2B:
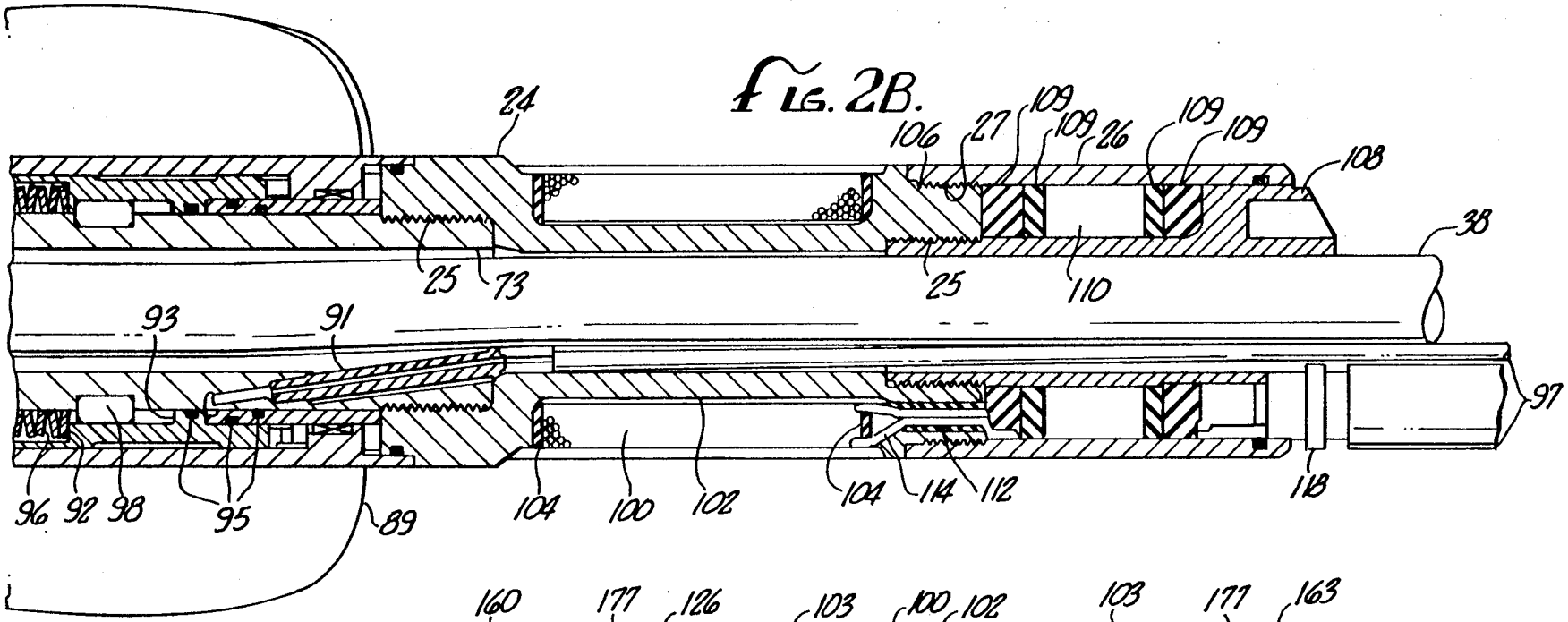

Turning in detail to the drawings, FIG. 1 illustrates the underground piercing tool of this invention which includes a generally axial hollow cylindrical body 10 comprised of a striker housing 12 having a tapered front end 11 and an open rear end 13 with internal threads 14, a connector cap 17, a shock housing 18, a rotating sleeve 20, a coil mandrel 24 and an outer sleeve 26. A pointed anvil 15 having a striking surface 16 at its rear end is secured to the front portion 11 of the striker housing 12. The front end of the connector cap 17 is threadably connected to the rear end 13 of the striker housing 12. The shock housing 18 having internal threads 19 is threadably connected to the rear end of the connector cap 17. The rotating sleeve 20 is slidably mounted about a connecting sub o isolator housing 22 and positioned between the shock housing 18 and the coil mandrel 24. The front end of the coil mandrel 24, having internal threads 25 located thereon, is threadably connected to the connecting sub 22. The rear end of the coil mandrel 24 is also provided with external threads 27 to which the outer sleeve 26 is threadably connected. The respective threads 14, 19, 25, and 27 allow for easy assembly and disassembly of the aforementioned components of the cylindrical body 10.

A striker 28 is slidably mounted in the striker housing 12 to reciprocate fore and aft with a front end surface 29 for impacting on the striking surface 16 of the anvil 15 to drive the tool in the forward direction. The outer surface of the striker 28 near the front is provided with cylindrical portions 32 for smooth engagement with the interior cylindrical surface of the body 10 and machined flat portions 33 for allowing air to pass through that area of the striker 28. The rear end of the striker 30 is provided with a cylindrical portion 34 slidably engaging the interior of the hollow cylindrical body 10 to comprise a piston and cylinder arrangement. The remaining exterior portions of the striker 28 are spaced from the interior of the striker housing 12 to provide annular passageways for the air during operation of the device.

The striker 28 is provided with a cylindrical cavity 35 at its rear end with radial ports 36 communicating the cavity 35 with the exterior of the striker 28. A valve body 40 is connected at its front end to a cylindrical valve sleeve 41 which in turn is slidably positioned in the cylindrical cavity 35 in the striker 28. Valve body 40 has external threads 43 at its rear end and a central bore 42 extending its entire length. The rear end of the valve body 40 is threadably connected to a hose coupling 44 which is connected to an air hose 38 for supplying compressed air through the valve body 40 to the cavity 35 of the striker 28. As the striker 28 reciprocates within the striker housing 12 causing the striker cavity 35 to reciprocate over the valve sleeve 41, the ports 36 of the striker are either closed by the valve sleeve 41 or opened when the ports are positioned to the front or rear of the valve sleeve 41.

When the striker 28 is in the position shown in FIG. 1, the compressed air is supplied through the ports 36 to the entire front of the striker 28 forward of the cylindrical portion 34 urging the striker 28 rearwardly in its return stroke. However, as the ports 36 are closed, the cavity 35 and valve sleeve 41 form a piston and cylinder which is continually supplied with compressed air and therefore tends to arrest the rearward movement of the striker 28 in opposition to the compressed air previously admitted to the front of the striker 28. As the ports 36 pass the rear of the valve sleeve 41 to thereby exhaust the compressed air previously trapped in front of the striker 28, the compressed air within the cavity 35 drives the striker 28 forwardly to impact surface 16 to complete the cycle.

The valve body 40 has a cylindrical portion 45 extending from the rear end where it is connected to the hose coupling 44 forwardly for a substantial portion of the valve body 40 to a front end where it is secured to the valve sleeve 41. The rear end of the cylindrical portion 45 of the valve body 40 is slidably received in the cylindrical interior of a valve guide generally designated 46. The valve guide 46 is supported in the connector cap 17 of the hollow body 10 by an elastomeric sleeve or bushing 47 which serves as a shock absorber and support for the valve guide 46. The elastomeric bushing 47 is tightly fitted over the cylindrical outer surface of the guide 46 and then press fitted into the connector cap 17. The bushing 47 has a plurality of longitudinally extending holes 50 or other convenient shape through which the compressed air exhausts during the rearward stroke of the striker 28.

A coil type compression spring 54 surrounds the mid portion of the valve body 40 and extends between the rear shoulder of the valve sleeve 41 and the front end 55 of the valve guide 46 to continually urge the valve body 40 forwardly relative to the valve guide 46. After the valve body 40 has been assembled to the valve guide 46 by compressing the spring 54 therebetween the striker housing 12 and connector cap 17 may be threadably connected to complete the assembly of this portion of the cylindrical body 10.

Turning in detail to FIGS. 2A and 2B, a hose coupling 44 on the front end of the air hose 38 is threadably secured to the valve body 40, before the connector cap 17 is threadably connected into the front end of the hollow cylindrical shock housing 18. The housing 18 includes a smooth mid-portion 62 for engagement with an elastomeric member 70 such as an elastomeric sleeve or bushing, and a protruding shoulder 63 which inclines upwardly and rearwardly to form a conically-shaped surface 66 which is joined to a thin rear portion 64 having a smooth cylindrical internal surface 65. The shock housing 18 also encircles and supports the front end 68 of the connecting sub or isolator housing 22.

The connecting sub or isolator housing 22 is a hollow cylindrically shaped member positioned between the air hose 38 and the cylindrical body 10 and is comprised of a front end 68 having an externally protruding shoulder 74, a rear end 73 having external threads thereon, an annular seat or recessed portion 72 for receiving an elastomeric sleeve 70, and an inclined surface 75 located approximately midway between the front end 68 and the rear end 73 of the connecting sub 22. The connecting sub 22 interconnects the front portion of the cylindrical body 10 comprised of the striker housing 12, connector cap 17 and shock housing 18 with the rear portion of the cylindrical body 10 comprised of the rotating sleeve 20, coil mandrel 24 and outer sleeve 26. As shown in FIGS. 2A and 2B, the isolator housing 22 is separate from and in a spaced relationship with the air hose 38 in order to, among other things, permit the isolator housing 22 to freely move axially relative to the air hose 38 without any undue stress being imposed on the isolator housing 22 by the air hose 38.

The elastomeric sleeve 70 which serves as a shock absorber and resilient support for the connecting sub 22 is tightly fitted over the front end of the connecting sub 22 into the annular seat 72 formed thereon. The elastomeric sleeve 70 and connecting sub 22 slidably engage the shock housing 18 sandwiching the elastomeric sleeve 70 between the mid portion 62 of the shock housing 18 and the annular seat 72. One end of the elastomeric sleeve 70 engages the shoulder 63 of the shock housing 18 while the other end of the elastomeric sleeve 70 engages the shoulder 74 projecting outwardly from the end of the annular seat 72. The radial thickness of the elastomeric sleeve 70 is shaped to provide a predetermined radial distance or clearance 77 between the connecting sub 22 and the shock housing 18 at the front and rear of the elastomeric sleeve 70 to allow the elastomeric sleeve 70 room to compress or deform when subjected to an impact force and longitudinally shaped to provide sufficient length to allow it to maintain its concentric alignment when subjected to impact forces in its mounted position and to allow axial movement to absorb impact forces. For purposes of this disclosure, any reference to an "axis" refers to an imaginary axis extending along the length of the cylindrical body 10. Mounted in this way, the elastomeric sleeve 70 permits the isolator housing 22 to move axially relative to the shock housing 18.

A locknut 78 is threaded into the front end of the shock housing 18 which has a plurality of keyways 76 and one or more keys **76*a* are installed to secure the position of the locknut 78 relative to the front end 68 of the connecting sub 22. A variable pre-load or force is axially applied by the locknut 78 which presses a spacer 79 against the shoulder 74 of the connecting sub 22 thereby compressing the elastomeric sleeve 70 between the connecting sub 22 and the shock housing 18. A retainer ring 48 is inserted into a groove formed in the internal cylindrical surface 49 of the rear end of connector cap 17 before the connector cap is threaded onto the shock housing 18 for retaining the keys 76*a* in the keyways 76**.

The internal surface 65 of the shock housing 18 slidably rests on the proximate end of hollow cylindrically-shaped bearing housing 80 while the stepped shaped distal end of the bearing housing 80 supports the front end of the hollow cylindrical rotating sleeve 20. An O-ring 84, bearing ring 86 and wear ring 88 are positioned in respective apertures and/or steps on the bearing housing 80 and sandwiched by the front end of the rotating sleeve 20. The bearing housing 80 is also provided with an internal surface 82 shaped to fit the inclined surface 75 of the connecting sub 22 such that the bearing housing 80 is wedged between the inclined surface 75 of the connecting sub 22 and the thin rear portion 64 of the shock housing 18.

The rotating sleeve 20 having guiding fins 89 for controlling and manipulating the direction of travel of the pneumatic piercing tool is slidably mounted to rotate about the connecting sub 22. The rear end of the rotating sleeve 20 is slidably mounted to the front end of the coil mandrel 24. A control member 91 for controlling the manipulation of the rotating sleeve 20 is interconnected with a twin line hose generally designated as 97. A piston arrangement generally designated as 90, comprising a piston 92, a spacer 94, a biasing means such as a spring 96 and a plurality of dowel pins 98 is positioned between the rotating sleeve 20 and the connecting sub 22. The biasing means 96 is mounted between the connector sub 22 and piston 92 and retained therein by the bearing housing 80 and the spacer therebetween. The dowel pins 98 are positioned to limit the compressing movement of the piston 92 by engaging a protruding member 93. A plurality of O-rings 95 are also provided in respective notches in the piston arrangement 90.

The front end of the hollow cylindrical coil mandrel 24 is threadably connected to the rear end 73 of the connecting sub 22. The coil mandrel 24, outer sleeve 26 and a sensor housing 108 together support the components of a sensor system. A magnetic source coil 100 is secured in a cylindrical aperture 102 about the coil mandrel 24. A first and second gasket 104, respectively, are constrained within the aperture 102 in the front and rear of the magnetic coil 100. The outer sleeve 26 and the roll sensor housing 108 are threadably secured to the external threads 106 and internal threads 25 on the rear end of the coil mandrel 24, respectively. A roll sensor 110 mounted to the roll sensor housing 108 is thereby sandwiched between the outer sleeve 26 and the roll sensor housing 108. First and second rubber spacers 109 are respectively mounted on opposite sides of the roll sensor housing 108 and firmly locate and constrain the roll sensor 110. A rubber bushing 112 is also provided along the outside of a wire trough 114 carrying the electric current from the roll sensor 110 and magnetic coil 100 to the twin line hose 97 secured to the pneumatic tool by a hose connector 118.

In operation, the isolator assembly allows axial movement of the cylindrical body 10 relative to the connecting sub or isolator housing 22. As the striker 28 impacts the striking surface 16 the impact force causes the piercing tool, generally, to accelerate and the shoulder 63 on the shock housing 18 to exert an axial force on the elastomeric sleeve 70 in the forward direction. The elastomeric sleeve 70 is subjected to a shearing motion between its outer surface and its inner surface for absorbing or dissipating the impact force and reducing the acceleration load or force experienced by the isolator housing 22, the components mounted thereon, and all of the components in the rear portion of the cylindrical body 10. Additionally, upon impact of the striker 28 the front portion of the cylindrical body 10 is permitted to accelerate forward while the rear portion of the cylindrical housing 10 including the guidance and steering system initially remains at rest for subsequently accelerating at a slower rate than the front portion of the cylindrical body 10 thereby improving the forward movement of the tool. The predetermined distance or clearance 77 also permits the elastomeric sleeve 70 to dissipate or absorb lateral vibrations and forces while avoiding unnecessary contact between the front end of the connecting sub 22 and the shock housing 18.

Figure 3:
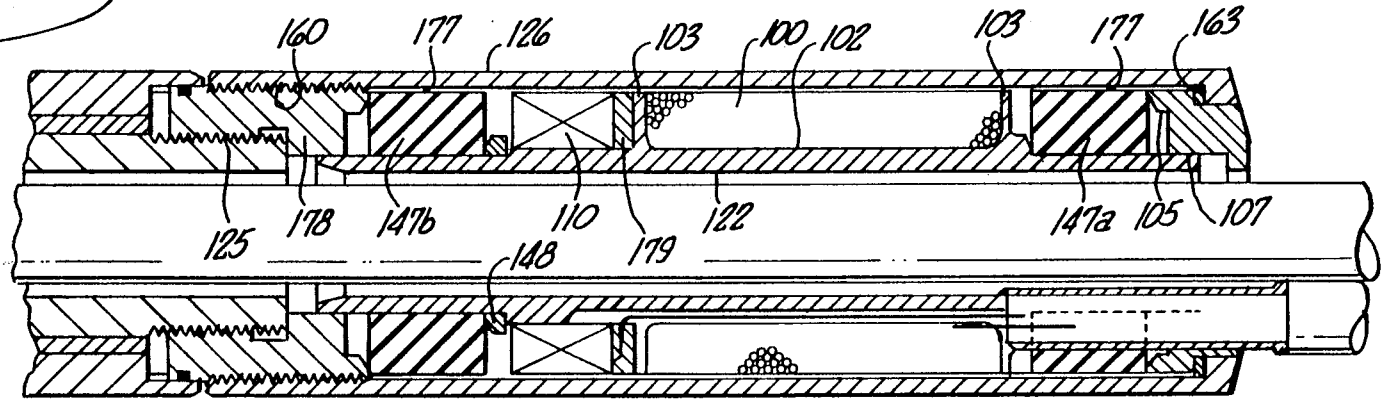
FIG. 3 is an enlarged fragmentary sectional side view of a second embodiment of the isolator assembly applied directly to the components of the sensor assembly.

Turning in detail to FIG. 3, a second embodiment of the isolator assembly as applied directly to the coil mandrel 24 and outer sleeve 26 is disclosed. Some of the components of the isolator assembly disclosed in FIG. 3 are identical to respective components in the coil mandrel 24 and outer sleeve 26 portions of the cylindrical body 10 disclosed in FIG. 2B and will be identified by the identical numeral without detailed description while other elements are similar and will be given the same numerals in the 100 series.

An isolator housing 122 supporting a sensor assembly of a pneumatic underground piercing tool is slidably supported in and permitted to move axially relative to a hollow cylindrical end cap 126 having internal threads 160 at its front end and an inwardly projecting shoulder 163 at its rear end. The isolator housing 122 is provided with a pair of outwardly projecting flanges 103 which form a cylindrically shaped recess 102 to provide a support for the magnetic coil 100. A first elastomeric member **147*a* such as an elastomeric sleeve or bushing which serves as a shock absorber is press fitted over the rear end of isolator housing 122 and positioned between one flange 103 and a protruding member of a housing mount 105. The housing mount 105 slidably supports the rear end of the isolator housing 122 on a cylindrical step shaped surface 107. A spacer 179 is slidably mounted over the front end of the isolator housing 122 and positioned between the forward flange 103 and the roll sensor 110. A retainer ring 148 is mounted to secure the roll sensor 110 from sliding along the isolator housing 122. A second elastomeric member 147*b* such as an elastomeric sleeve or bushing which serves as a shock absorber is press fitted over the front end of the isolator housing 122. A biasing means 178 such as locknut is threaded into the end cap 126 and biases or compresses the first and second elastomeric sleeves 147*a*, 147*b* towards each other while slidably supporting the front end of the isolator housing 122. The first and second elastomeric sleeves 147*a*, 147*b* are shaped to provide a predetermined distance or clearance 177 between their outer surface and the inner surface of the end cap 126 to allow the elastomeric sleeves 147*a*, 147*b* room to expand when subjected to impact forces. Thus, the first and second elastomeric sleeves 147*a*, 147*b* are mounted such that they are allowed to move relative to the clearance 177 and, to a greater extent than the first embodiment, isolates the motion of the isolator housing 122 relative to the cylindrical body 10. Once the locknut 178 is secured inside the end cap 126** the assembly may be threadably connected to the connecting sub.

In operation, the second embodiment of the isolator assembly is relatively similar in concept to and may be utilized in conjunction with the first embodiment of the isolator assembly. The second embodiment of the isolator assembly provides several advantages. For example, it is substantially easier to assemble, disassemble and maintain. The sensor assembly disclosed in FIG. 3 and the components thereof are protected from both directions of shock loads and/or stress waves by two elastomeric sleeves **147*a*, 147*b*. As the underground piercing tool moves forward the elastomeric sleeves 147*a*, 147*b* substantially isolate the components of the sensor assembly from impact forces by permitting the isolator housing 122 supporting said components to move axially relative to the end cap 126 and by absorbing or dissipating the impact forces experienced by the components. The effect of the impact forces on each of the elastomeric sleeves 147*a*, 147*b* will vary depending upon the resistance experienced by the piercing tool during operation. If the piercing tool is moving forward with minimal or moderate resistance the shock loads on the isolator housing 126 will primarily be dissipated by the first elastomeric member 147***a* mounted to the rear end of the isolator housing 122. Under greater resistance, both the first and second elastomeric members 147*a*, 147*b* will be substantially loaded and both will be substantially utilized to dissipate the impact forces. In the event the piercing tool encounters an obstruction or non-compactible soil and cannot move forward the second elastomeric member 147*b* mounted to the front end of the isolator housing 126 will primarily be subjected to the impact forces and utilized to dissipate the same.

Thus, an isolator assembly is disclosed which reduces the negative effects of the impact forces of the striker on the various internal components of the piercing device such as the components of a guidance and steering system. The isolator assembly absorbs and dissipates shock loads of the tool by permitting axial movement of external body components and internal housing components relative to each other. Thus, an improved underground piercing tool with a guidance and steering system that allows the tool to operate in the field with greater reliability is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An isolator assembly for supporting internal components inside a pneumatic underground piercing tool having an axial body propelled by impact forces of a striker responsive to the application of compressed air introduced through an air hose to a valve body for controlling the compressed air supplied to the striker, said isolator assembly comprising:

an isolator housing supporting internal components separate from the axial body, striker and valve body, wherein said isolator housing is positioned within an isolator body connected to the axial body, said isolator housing being separate from and in a spaced, substantially non-contacting relationship with the air hose and supported in said isolator body by at least one elastomeric member which allows said isolator housing to move axially relative to said isolator body and the air hose.

2. The isolator assembly of claim 1 wherein said elastomeric member is preloaded under an axially directed compressive force.

3. The isolator assembly of claim 1 or 2 wherein said elastomeric member is positioned between the isolator body having a first shoulder protruding towards said isolator housing and the isolator housing having a second shoulder protruding towards said isolator body wherein said elastomeric member is engaged by said first shoulder and said second shoulder.

4. The isolator assembly of claim 3 wherein said elastomeric member is shaped to prevent said first shoulder from contacting said isolator housing and said second shoulder from contacting said isolator body.

5. The isolator assembly of claim 2 wherein said elastomeric member is longitudinally shaped to retain coaxial alignment of its shape when compressed.

* * * * *